United States Patent [19]

Sommer

[11] Patent Number: 4,966,093

[45] Date of Patent: Oct. 30, 1990

[54] DEVICE FOR CONTINUOUSLY COATING A WEB OF MATERIAL TRAVELING AROUND A BACKING ROLLER

[75] Inventor: Herbert Sommer, Düsseldorf, Fed. Rep. of Germany

[73] Assignee: Jagenberg Aktiengesellschaft, Dusseldorf, Fed. Rep. of Germany

[21] Appl. No.: 385,345

[22] Filed: Jul. 25, 1989

[30] Foreign Application Priority Data

Jul. 29, 1988 [DE] Fed. Rep. of Germany ..... 3825816

[51] Int. Cl.[5] ..... B05C 11/04

[52] U.S. Cl. ..... 118/126; 118/413; 118/419

[58] Field of Search ..... 118/126, 413, 419, 117, 118/122, 11 G

[56] References Cited

U.S. PATENT DOCUMENTS

| | | | |
|---|---|---|---|
| 3,128,207 | 4/1964 | Schmitt | 118/126 |
| 4,220,113 | 9/1980 | Wohlfeil | 118/126 |
| 4,233,930 | 11/1980 | Wohlfeil | 118/413 |
| 4,375,202 | 3/1983 | Miller | 118/126 |
| 4,706,603 | 11/1987 | Wohlfeil | 118/413 |

FOREIGN PATENT DOCUMENTS

| | | |
|---|---|---|
| 2824907 | 7/1984 | Fed. Rep. of Germany . |
| 3017274 | 7/1985 | Fed. Rep. of Germany . |

*Primary Examiner*—Jay H. Woo
*Assistant Examiner*—Khanh P. Nguyen
*Attorney, Agent, or Firm*—Sprung Horn Kramer & Woods

[57] ABSTRACT

A known device for continuously coating a web (1) of material traveling around a backing roller (2), especially a web of paper or cardboard, with a resilient doctor blade (3) that is secured at the foot to a pivoting doctor beam (4) and with an element (10) for supporting the doctor blade above where it is secured to the side that faces away from the backing roller, whereby the attachment (8) of the foot of the doctor blade can be set independently of the supporting element to adjust the pressure of the doctor blade against the backing roller. The device has means (13–22) for pivoting the doctor beam to compensate for the change in the angle of the point of the doctor blade that results when the foot of the doctor blade is set.

9 Claims, 2 Drawing Sheets

DEVICE FOR CONTINUOUSLY COATING A WEB OF MATERIAL TRAVELING AROUND A BACKING ROLLER

FIELD OF THE INVENTION

The invention concerns a device for continuously coating a web of material traveling around a backing roller, especially a web of paper or cardboard.

BACKGROUND OF THE INVENTION

The foot of the blade in known coating devices that employ a doctor blade as a flow-control mechanism rests on a blade beam that pivots to establish a prescribed angle (the blade angle) between the blade, the point of which rests against the web, and a tangent to the backing roller at the line of contact. The pressure of the blade against the backing roller determines the coating density and is established by resiliently deforming the blade between its foot, which is tensioned into the blade, and its point. The change in the blade angle due to the deformation must be kept as slight as possible.

DISCUSSION OF PRIOR ART

A coater that is very satisfactory from this aspect is described in German Patent No. 2 825 907. The deformation in this device is achieved by linearly displacing the foot of a doctor blade that is tensioned into a beam. The blade is supported on a batten that does not alter when the tensioning beam is displaced. Relatively small motions of the tensioning beam accordingly generate relatively large changes in pressure, and the effect of the blade angle is so slight that almost no qualitative drawbacks result in practice, almost without exception. Another advantage is that the S-shaped deformation of the blade results in a highly satisfactory transverse blade stability even at very slight pressures, which is of decisive significance to a uniformly thick coating across the direction that the web travels in.

Another generic device is known from German Patent No. 3 017 274, wherein the tensioning beam pivots to adjust its tension relative to the supporting batten.

Subject to extreme conditions, problematical coating rheology for example, and when the coating must be high-quality, it is desirable to decrease the already weak effect of a change in tension on the blade angle even more.

OBJECT OF THE INVENTION

The object of the invention is accordingly to provide a coating device wherein the constancy of the blade angle can be further improved when the tension is varied.

SUMMARY OF THE INVENTION

This object is attained by starting with a device for continuously coating a web of material traveling around a backing roller, such as a web of paper or cardboard, and including a resilient doctor blade that is secured at its foot to a pivoting doctor beam, and an element for supporting the doctor blade above where it is secured to the side that faces away from the backing roller, whereby the attachment of the foot of the doctor blade can be set independently of the supporting element to adjust the pressure of the doctor blade against the backing roller. In accordance with the invention there are provided means for pivoting the doctor beam so as to compensate for the change in the angle of the point of the doctor blade that results when the foot of the doctor blade is set.

Advantageously, the doctor beam can be pivoted around the line of contact between the doctor blade and the backing roller and the means for setting the foot of the doctor blade is mechanically coupled to the mechanism for pivoting the doctor beam. The foot point of the doctor blade can be set in a straight line at an acute angle to the doctor blade. Preferably the angle between the undeformed doctor blade and the direction that the foot point moves in is between 70° and 80°, especially 75°, the device including means for proportionally varying the angle of the doctor beam in accordance with the setting of the tensioning beam.

Finally, there may be provided an electronic coupling between the means that sets the foot of the doctor blade and the means that pivots the doctor beam.

The subsidiary claims recite preferred embodiments.

BRIEF DESCRIPTION OF THE DRAWINGS

The drawings schematically illustrate two embodiments of the invention.

SPECIFIC DESCRIPTION

Figure 1:
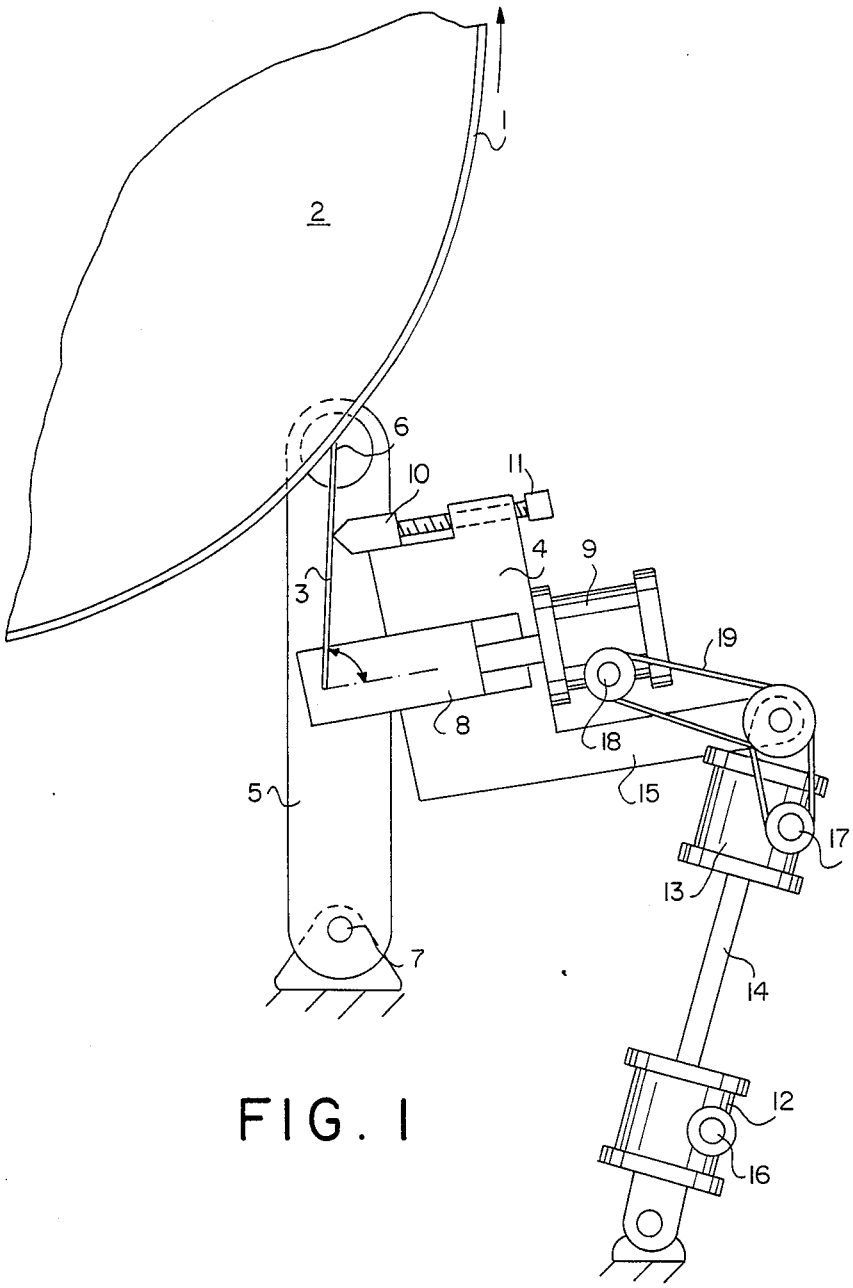
FIG. 1 is a cross-section through a device in accordance with the invention wherein the doctor-beam angle setting is mechanically coupled to tensioning-beam adjustment and FIG. 2 schematically illustrates a device wherein the doctor-beam angle is electronically controlled.

The web 1 of material to be coated, a web of paper for example, travels around a backing roller 2 in the direction indicated by the arrow in the device in accordance with the invention. The coating is applied to the web in excess by an unillustrated coating-application system and is reduced to the desired thickness by the flow-control system that will now be described in greater detail.

The flow-control system comprises a scraping blade 3 secured in a doctor beam 4 suspended such that it can pivot in a stand 5 at one side around the line of contact (flow-control line 6) between the point of the blade and backing roller 2 in order to establish a prescribed beam angle (the angle between the tangent to the backing roller and the undeformed blade). The lateral stand 5 can be swung along with beam 4 around an axis 7 away from backing roller 2 for cleaning purposes or to change the doctor blade.

Integrated into doctor beam 4 is a tensioning beam 8 that can be shifted linearly, more or less horizontally when swung into position. The foot of blade 3 is tensioned into tensioning beam 8, establishing an angle of 70–80° and preferably approximately 75° between blade 3 and the direction that tensioning beam 8 moves in. Above the tensioning point of blade 3, a supporting batten 10 is secured to the side of doctor beam 4 that faces away from backing roller 2. Blade 3 rests against supporting batten 10, and the batten can be shaped to a prescribed contour with set screws 11 distributed at regular intervals along the operating width.

Doctor beam 4 is pivoted to establish a prescribed beam angle with a spindle-driven elevating mechanism 12.

The straight-line setting of the tensioning beam 8 in the device illustrated in FIG. 1 is mechanically directly coupled to the beam-angle adjustment by way of another spindle-driven elevating mechanism 13 mounted above first elevating mechanism 12 on a non-rotating spindle 14. Spindle 14 is articulated to a lever-like extension 15 and is axially adjusted with helical gear wheels 16 and 17. Gear wheel 16 is associated with lower elevating mechanism 12 and connected to a servo motor. Gear wheel 17 is associated with upper elevating mechanism 13 and is connected at a fixed transmission ratio to a helical gear wheel 18 driven by a spindle-driven elevating mechanism 9. The coupling in the present embodiment is incorporated by toothed belts 19, although articulated shafts or a conical transmission is also possible. Since the tensioning-beam setting is mechanically coupled directly to the beam-angle adjustment, setting the tensioning beam 8 with helical gear wheel 18 will cause spindle 14 to adjust the beam angle in proportion to the particular transmission ratio employed.

Figure 2:
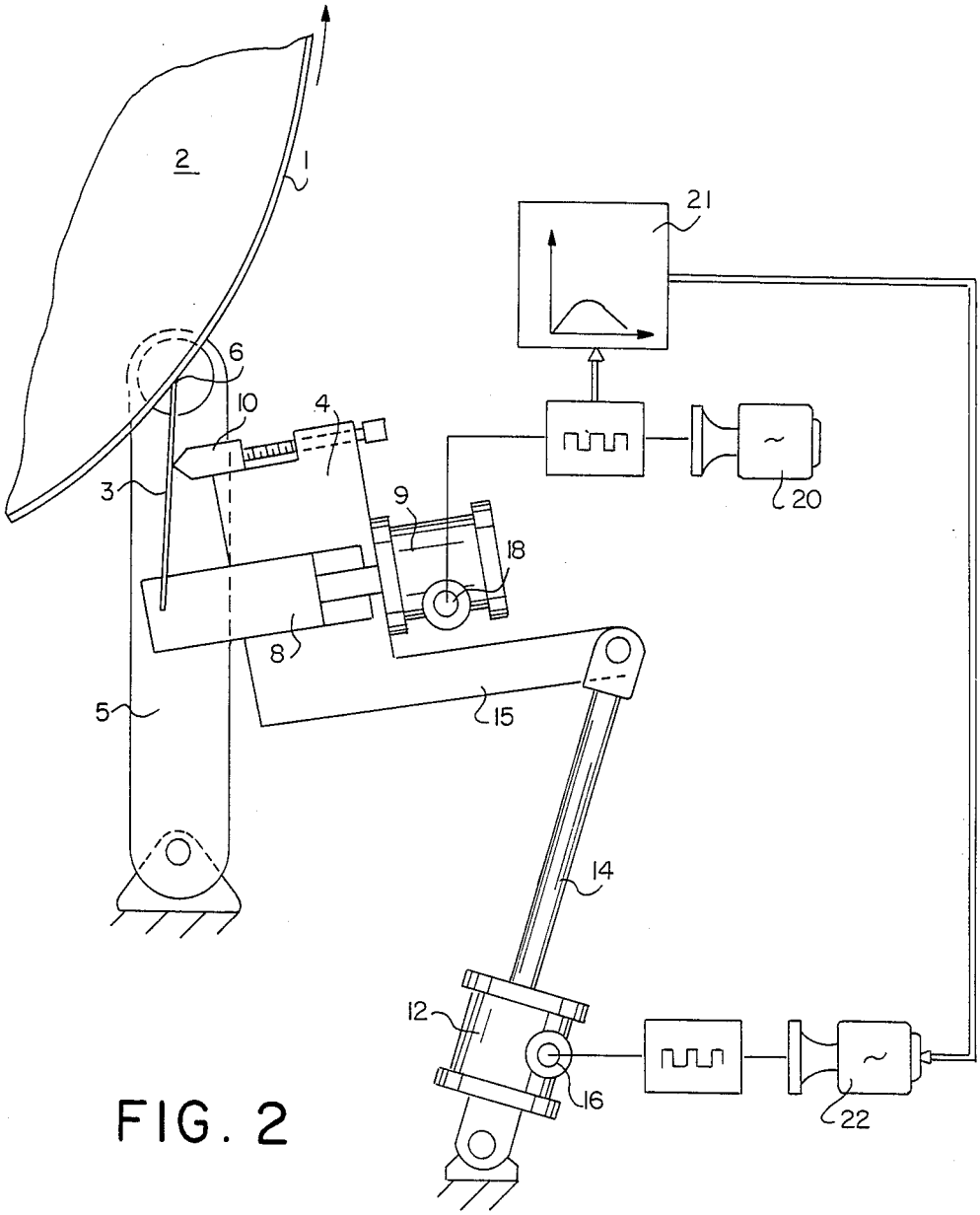

The beam angle in the embodiment illustrated in FIG. 2 is set in accordance with the adjustment of tensioning beam 8 by an electric motor. A microprocessor 21 is for this purpose connected to a pulse counter 19 that controls a servo motor 20 that drives elevating mechanism 9 to set the tensioning beam. Microprocessor 21 corrects the beam angle in accordance with the tensioning-beam setting by way of the mechanism 22 that drives elevating mechanism 12. A corresponding beam-angle correction is associated in microprocessor 21 with every position of the foot of blade 3, and the blade angle is accordingly compensated for every variation in the foot point. The advantage of this electronic embodiment, which is more complicated than the embodiment illustrated in FIG. 1, is that time-dependent changes, e.g. wear on blade 3, and other parameters that affect the blade angle, e.g. elastic deformation of the surface of the backing roller, the length of support, the mean beam angle, etc., can be exploited as parameters for calculating the beam-angle correct and can be varied as needed.

How the device illustrated in FIG. 1 works will now be explained.

Before the coating procedure commences, doctor beam 4 is pivoted toward backing roller 2 until the point of blade 3 rests against web 1 of material. The desired beam angle is then set with elevating mechanism 12. Depending on the desired pressure at the point of the scraper blade, tensioning beam 8 is then moved in a straight line away from backing roller 2 by elevating mechanism 9. Since supporting batten 10 remains unchanged, blade 3 will curve into an S, and its point will be forced against web 2. The deformation will produce a slight change in the blade angle between supporting batten 10 and flow-control line 6. This change is compensated by mechanically coupling elevating mechanism 13 in with belt 19 at the prescribed transmission ratio and raising spindle 14 slightly to pivot blade 3 until the originally established blade angle returns.

A deviation of 15° with respect to a blade 3 that is tensioned perpendicular to the direction of tensioning beam 8 will change the blade angle, due to the deformation, approximately in proportion to the utilizable displacement of the tensioning beam. It can accordingly be compensated by a proportional change in the beam angle. This is achieved in the embodiment illustrated in FIG. 1 with a simple mechanical coupling.

When the tensioning beam 8 in the embodiment illustrated in FIG. 2 is set, the pulse counter emits a corresponding number of distance-related pulses to microprocessor 21, which simultaneously controls the mechanism 22 that drives elevating mechanism 12 in accordance with a previously prescribed correction graph, and accordingly also pivots doctor beam 4 around the requisite corrective angle.

It will be understood that the specification and examples are illustrative but not limitative of the present invention and that other embodiments within the spirit and scope of the invention will suggest themselves to those skilled in the art.

What is claimed is:

1. In a device for continuously coating a web of material travelling around a backing roller and including a doctor beam, a doctor blade having a foot mounted on the doctor beam and an edge for contacting the web of material, means for setting an angle of the blade relative to a tangent to the backing roller, an element mounted on the doctor beam for supporting the doctor blade on a side facing away from the backing roller and between the foot and the edge, means for moving the foot of the doctor blade relative to the doctor beam and the supporting element when the edge is in contact with the web of material at the set angle to adjust the pressure of the blade against the backing roller and thereby deforming the blade and changing the set angle of the blade, wherein the improvement comprises means for pivoting the doctor beam and thereby the doctor blade to compensate for the change in the set angle when the pressure of the blade is adjusted to dispose the blade at the set angle.

2. The device according to claim 1, wherein the means for pivoting the doctor beam includes means for moving the doctor beam simultaneously with the moving of the doctor blade foot.

3. The device according to claim 1, wherein the means for pivoting the doctor beam includes means for moving the doctor beam subsequent to the moving of the doctor blade foot.

4. The device according to claim 1, wherein the means for moving the foot comprises means for moving the foot in a straight line disposed at an acute angle to the doctor blade.

5. The device according to claim 1, wherein the means for pivoting the doctor beam comprises means coupled with the means for moving the foot.

6. The device according to claim 5, wherein the means coupled with the means for moving the foot comprises an electronic coupling.

7. The device according to claim 4, wherein the undeformed doctor blade is at an angle of 70° to 80° with the straight line.

8. The device according to claim 4, wherein the undeformed doctor blade is at an angle of approximately 75° with the straight line.

9. The device according to claim 1, wherein the means for pivoting the doctor beam includes means for proportionally varying the angle of the doctor beam with a change in the pressure of the doctor blade on the backing roller.

* * * * *